US005783123A

United States Patent [19]

Edwards et al.

[11] Patent Number: 5,783,123

[45] Date of Patent: Jul. 21, 1998

[54] TILTABLE BANDING WHEEL AND METHOD FOR SECURING POTTERY ARTICLE THERETO

[75] Inventors: Debra C. Edwards, Banner Elk, N.C.; William B. Fountain, Park Forest, Ill.; Kenneth R. Harroff, Asheville; Jonathan C. Jones, Raleigh, both of N.C.

[73] Assignee: Appalachian State University, Boone, N.C.

[21] Appl. No.: 791,773

[22] Filed: Jan. 29, 1997

[51] Int. Cl.[6] ..... B28B 1/02

[52] U.S. Cl. ..... 264/39; 264/633; 264/679; 425/263; 425/459

[58] Field of Search ..... 425/263, 459; 264/633, 679, 39

[56] References Cited

U.S. PATENT DOCUMENTS

| | | | |
|---|---|---|---|
| 1,778,324 | 10/1930 | Kinnard et al. | 425/459 |
| 3,520,036 | 7/1970 | Maloney | 425/90 |
| 3,605,218 | 9/1971 | Rasmussen et al. | 425/459 |
| 3,796,105 | 3/1974 | Menard | 477/7 |
| 3,894,830 | 7/1975 | Edwards | 425/459 |
| 4,028,041 | 6/1977 | Zambrano, Jr. | 425/459 |
| 4,057,384 | 11/1977 | Reid | 425/459 |
| 4,061,460 | 12/1977 | George | 425/459 |
| 4,102,622 | 7/1978 | Simpson | 425/459 |
| 4,222,577 | 9/1980 | Giffin | 425/459 |
| 4,297,309 | 10/1981 | North | 264/148 |
| 4,332,542 | 6/1982 | Matsui | 425/459 |
| 4,585,240 | 4/1986 | Giffin | 279/111 |
| 4,702,920 | 10/1987 | Goodman | 425/459 |
| 5,180,174 | 1/1993 | Province | 279/6 |

FOREIGN PATENT DOCUMENTS

| | | | |
|---|---|---|---|
| 29617765 | 12/1996 | Germany | 425/459 |
| 22168040 | 10/1989 | United Kingdom | 425/263 |
| 2251574 | 7/1992 | United Kingdom | 425/459 |

OTHER PUBLICATIONS

Field Enterprises Educational Corporation, The World Book Encyclopedia, "Pottery", vol. 13, pp. 6538–6542 (1959).

*Primary Examiner*—Robert Davis
*Attorney, Agent, or Firm*—Jenkins & Wilson, P.A.

[57] ABSTRACT

A banding wheel comprising a turntable and a tilting mechanism. The turntable is (i) rotatable, and (ii) adapted for releasable attachment to a pottery article support plate. The plate is adapted for releasably securing a pottery article to the banding wheel. The tilting mechanism is operatively connected to the turntable and adapted for tilting the turntable so that when the mechanism is in its closed position the turntable is horizontally disposed and when the mechanism is in its open position, the turntable is angularly disposed.

10 Claims, 5 Drawing Sheets

TILTABLE BANDING WHEEL AND METHOD FOR SECURING POTTERY ARTICLE THERETO

TECHNICAL FIELD

The present invention relates, in general, to ceramic technology. More particularly, the present invention relates to a banding wheel having a novel mechanism for tilting the turntable of the banding wheel, and a plate that is attached to the turntable so that a pottery article can be then secured to the plate to facilitate work thereon. As a result, when the tilting mechanism is in its fully open position, the turntable is angularly disposed up to about 10° from vertical, and yet the pottery article remains secured to the plate.

BACKGROUND OF THE INVENTION

As is well known, pottery may be a tile, pot, bowl, plate, cup, and the like, that is made of baked clay. While the finest kind of pottery is known as porcelain, all other kinds of pottery are known as either earthenware or stoneware (which is sometimes referred to as stoneware). Porcelain is translucent (i.e., light will show through it) and is made of white clay, whereas earthenware is opaque (i.e., light will not show through it) and is made of red, brown, yellow, gray, or white clay. Certain very fine earthenware is partially translucent.

Pottery making is an extremely old human craft, and prehistoric humans shaped all pottery by hand. Then, someone discovered the use of a rotating wheel, namely a turntable, for shaping pottery. The turntable of the early potter's wheel turned as a user worked a kick wheel, and some traditional potter's wheels still work manually this way. However, a modern potter's wheel uses a motor to turn the turntable.

Making pottery begins with choosing an appropriate clay, removing grit and other debris so that the clay will be smooth, and adding enough water so that the clay can be kneaded into a dough. Next, the potter places a portion of the wet clay onto the center of the turntable of the potter's wheel, wets his hands, and rotates the turntable while hand-shaping the clay into a desired form.

The wet formed clay is allowed to dry, and becomes a dried pottery article, which then is fired in an oven called a kiln. Typically, the kiln is turned off and left to cool for several days before removing the fired pottery article. The unglazed, fired pottery article, after this first firing, is known as "bisque" pottery.

Glaze is then applied to the bisque pottery to give it a shiny coating, after which it is fired a second time to fuse the glaze. Sometimes, glaze is applied to the dried pottery article prior to the first firing, in which case the glaze fuses at the same time that the clay is baked when the pottery article is fired. Glaze may be applied with a brush or by dipping the pottery article into a container of glaze. However, earthenware is not necessarily glazed, and some of the finest Wedgewood pottery articles are unglazed. Both glazed and unglazed pottery articles may be subsequently painted.

Related to potter's wheels are banding wheels that can be used to hold and rotate the bisque ware while glazes are applied to the surface of the bisque ware. By contrast, potter's wheels are used to shape wet clay prior to firing thereof.

Representative prior art patent references that are of interest with respect to pottery wheels and banding wheels include U.S. Pat. No. 5,180,174 to Province; U.S. Pat. No. 4,702,920 to Goodman; U.S. Pat. No. 4,585,240 to Giffin; U.S. Pat. No. 4,332,542 to Matsui; U.S. Pat. No. 4,061,460 to George; U.S. Pat. No. 4,028,041 to Zambrano, Jr.; U.S. Pat. No. 3,894,830 to Edwards; U.S. Pat. No. 3,796,105 to Menard; U.S. Pat. No. 3,605,218 to Rasmussen et al; and U.S. Pat. No. 3,520,036 to Maloney. The disclosures of all of the above-noted patents are incorporated herein by reference.

SUMMARY AND OBJECTS OF THE INVENTION

The present invention provides a banding wheel comprising a turntable and a tilting mechanism. The turntable is (i) rotatable through 360°, and (ii) adapted for releasable attachment to a support plate, wherein the plate is adapted for releasably securing a pottery article to the banding wheel. The tilting mechanism is operatively connected to the turntable and adapted for selectively tilting the turntable. When the mechanism is in its closed position, the turntable is horizontally disposed, and when the mechanism is in its open position, the turntable is angularly disposed at about 10° from vertical.

Also, the present invention provides, in combination, a banding wheel and a plate. The banding wheel of the combination comprises a turntable and a tilting mechanism as described above. The plate of the combination comprises a top surface and a bottom surface, and includes on its top surface a mesh screen covered with a layer of paraffinic coating to facilitate adhesive engagement of a pottery article.

Furthermore, the present invention provides a process for releasably securing a pottery article to a banding wheel, wherein the process comprises the steps of providing a banding wheel and a plate as described above. Then, the process comprises providing a heated pottery article having a bottom and placing the pottery article with its bottom on the coating layer, and releasably securing the pottery article to the banding wheel by allowing the coating to be heated and then to cool, thereby hardening the coating so as to secure the pottery article thereto. An alternative method comprises heating the coating until melted and placing a pottery article on the coating and allowing it to cool. As a result, the turntable with the pottery article secured thereto may be tilted via the tilting mechanism up to about 10° from vertical without the pottery article being released from the plate and falling from the turntable.

Preferably, the above-described tilting mechanism of the invention includes (1) an upper base block having a top and a bottom, with the top having the turntable disposed thereon, (2) a lower base block having a top and a bottom, and (3) a movable arm. The arm has a top portion, a bottom portion, and an articulating elbow joint, with the arm top portion attached to the upper base block and the arm bottom portion attached to the lower base block. Also, the tilting mechanism preferably includes (1) a connector block having a top, a bottom, a front, and a back, and (2) a first hinge and a second hinge, with the first hinge connecting the upper base block to the top of the connector block and the second hinge connecting the lower base block to the bottom of the connector block.

Additionally, the tilting mechanism preferably includes a motor secured to the connector block, wherein the motor is operatively coupled to the articulating elbow joint of the movable arm by a threaded rod passing through an orifice in the connector block and a threaded aperture in the elbow joint, such that running the motor allows for vertically moving the movable arm which in turn tilts the upper base block and thereby tilts the turntable.

Thus, it is an object of the invention to allow for tilting a turntable of a banding wheel, with a pottery article secured thereto, up to about 10° from vertical without the pottery article falling therefrom to facilitate better access to all surfaces of the pottery article.

It is a further object of the invention to provide such a banding wheel that can be used by a quadriplegic.

Some of the objects of the invention having been stated above, other objects will become evident as the description proceeds, when taken in connection with the accompanying drawings as described below.

DETAILED DESCRIPTION OF THE INVENTION

The same numerals and letters are used to designate the same components in the different Figures.

Figure 1:
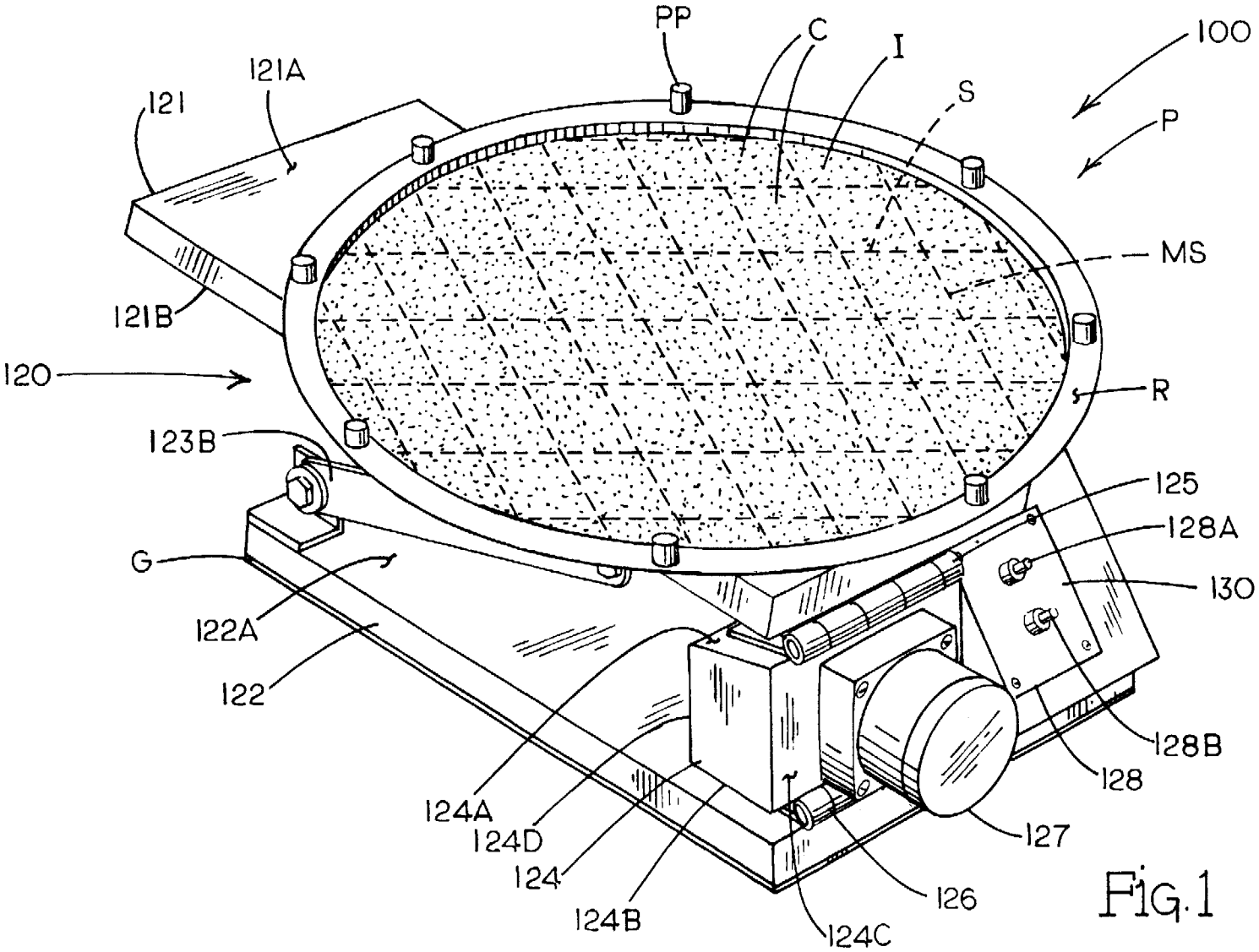
FIG. 1 is a pictorial view of the inventive combination banding wheel and support plate (showing the mesh screen and coating layer on the top surface of the plate), and illustrating the tilting mechanism of the banding wheel in the closed position.

Depicted in FIG. 1 is a pictorial view of banding wheel 100 in combination with plate P.

Figure 2:
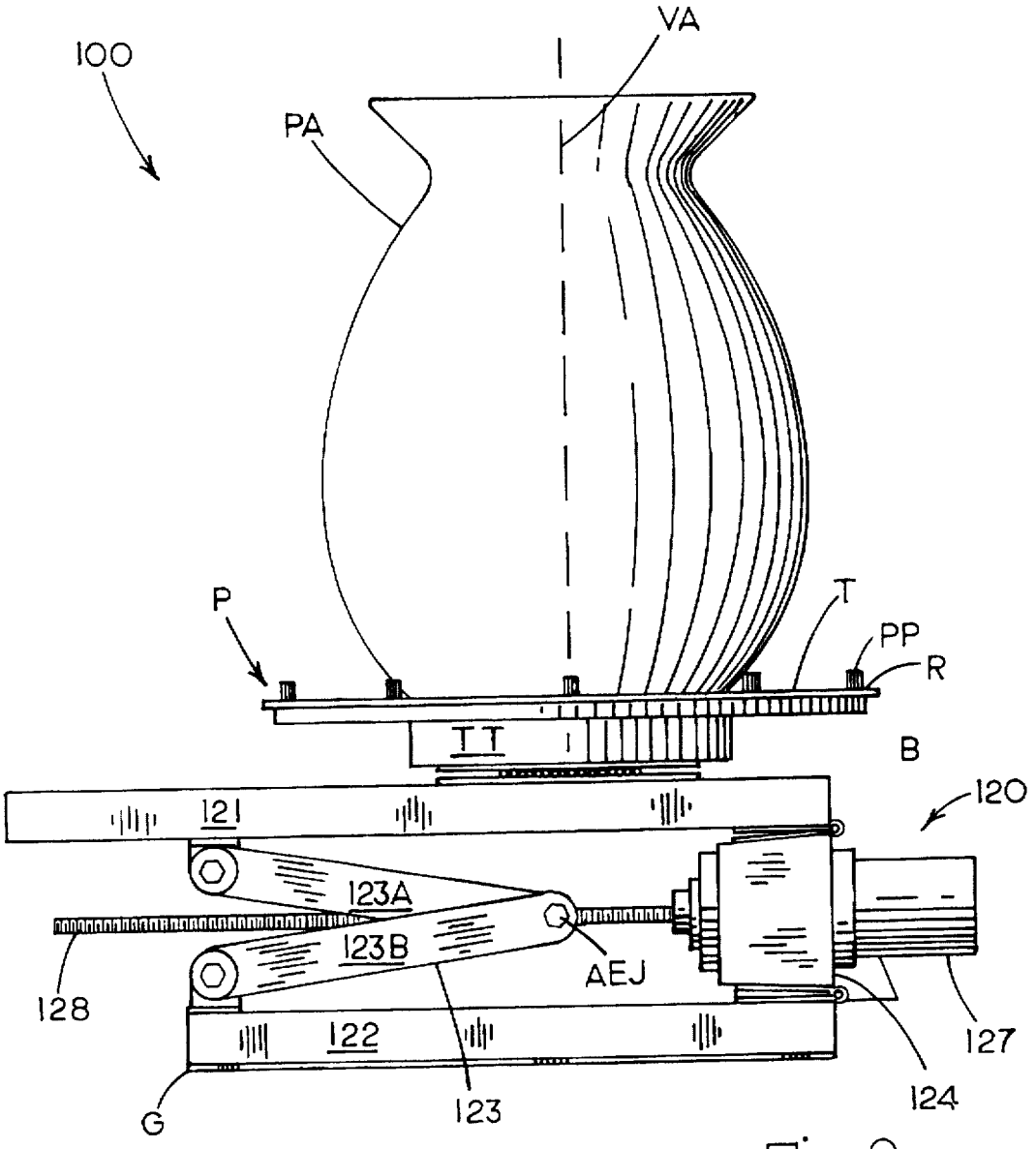
FIG. 2 is a side view showing the banding wheel and plate of FIG. 1, with the tilting mechanism of the banding wheel in the closed position, and further showing a pottery article secured to the banding wheel.

FIG. 2 illustrates a side view of the combination banding wheel 100 and plate P shown in FIG. 1, and additionally, illustrates pottery article PA, releasably secured, as further described below, to banding wheel 100, and turntable TT defining a vertical rotational axis VA. Pottery article PA has been bisque fired and/or glazed, as described in more detail below in connection with the inventive method.

Banding wheel 100 includes turntable TT that is rotatable through 360°, and further includes tilting mechanism 120. Although tilting mechanism 120 may be used by a person who is not paralyzed, tilting mechanism 120 is particularly intended, as discussed in more detail below, for use by a person who is a quadriplegic so that the quadriplegic may perform work on pottery article PA when it is secured to banding wheel 100. Tilting mechanism 120 is shown closed in FIGS. 1 and 2.

Figure 3:
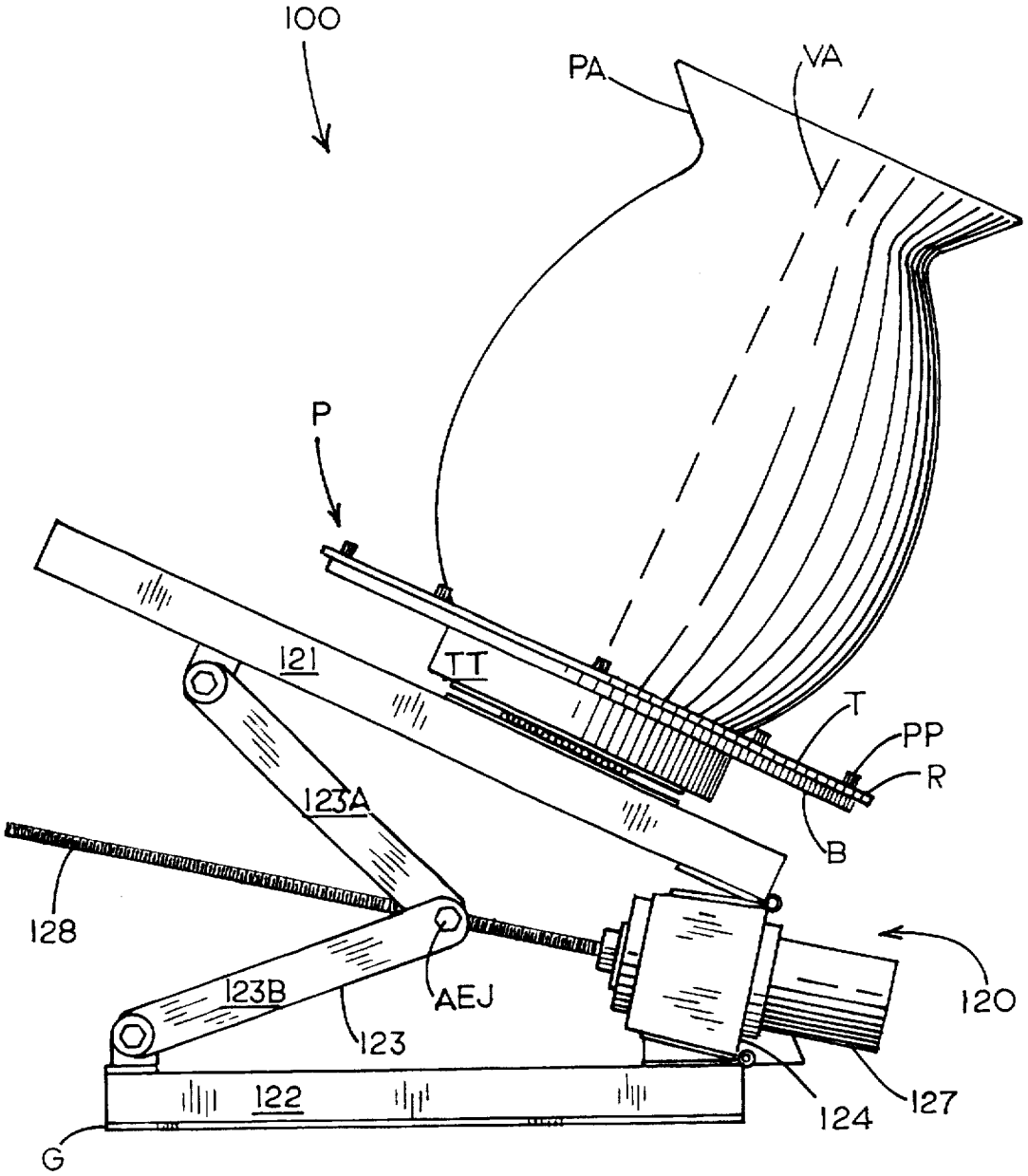
FIG. 3 is a side view of the banding wheel and plate, together with a pottery article, as in FIG. 2, but with the tilting mechanism of the banding wheel in the partially extended and open position.

FIG. 3 is similar to FIG. 2 and illustrates the combination banding wheel 100 and plate P and also pottery article PA, except tilting mechanism 120 is shown in its partially extended or open position.

Figure 4:
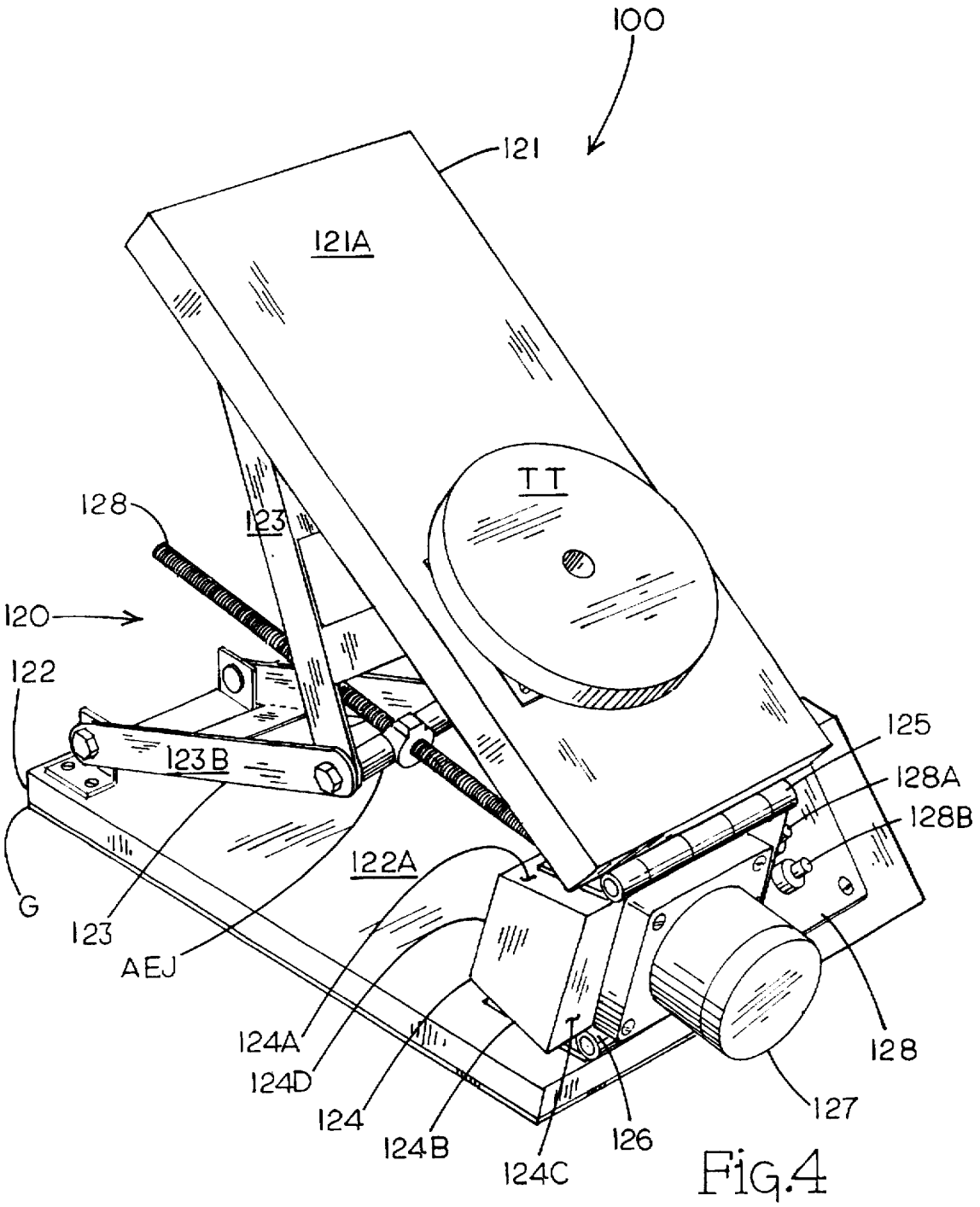
FIG. 4 is a pictorial view of the inventive banding wheel shown in FIG. 3, with the tilting mechanism in its partially extended and open position.

FIG. 4 is a pictorial of banding wheel 100 similar to FIG. 3, with tilting mechanism 120 in its partially extended or open position.

Plate P has top surface T and bottom surface B, and is adapted for releasable attachment to turntable TT. For instance, to attach turntable TT and plate P to each other, the top of turntable TT may be provided with an aperture (see FIG. 4) and a corresponding threaded aperture provided in threaded plate TP therebeneath (see, FIGS. 4 and 5) for receiving a threaded screw that is welded to bottom surface B of plate P (see FIG. 5).

Also, plate P is adapted to have mesh screen MS affixed to the top surface T thereof. Mesh screen MS is covered with a layer of paraffinic coating C, preferably a mixture of paraffin including beeswax, that fills the interstices thereof and substantially covers the mesh screen MS. As can be seen with reference to FIG. 1, mesh screen MS is shown with screen interstices I and screen surfaces S, and preferably, coating C is impregnated into screen interstices I and coated onto and over screen surfaces S, with coating C in plate P having a thickness of about 4 mm to about 8 mm. However, it is understood that the thickness may vary depending on the size and weight of pottery article PA and as a matter of design choice.

When tilting mechanism 120 is in its fully closed position, as shown in FIGS. 1 and 2, turntable TT is horizontally disposed. As shown in FIG. 3, turntable TT can be preferably angularly disposed so that its vertical rotational axis extends upwardly about 30° from vertical, when tilting mechanism 120 is in its partially open position (although other angles of tilt of turntable TT are clearly contemplated by applicants' invention). Consequently, due to the tilting of turntable TT as shown in FIG. 3, vertical rotational axis VA of pottery article PA is about 10° from perfect vertical (90°), and pottery article PA remains secured to potter's wheel 100 even though tilted. Thus, turntable TT can be selectively disposed at any angle from where pottery article PA has a vertical rotational axis VA to where pottery article PA has a vertical rotational axis VA that is about 10° offset from vertical.

Figure 5:
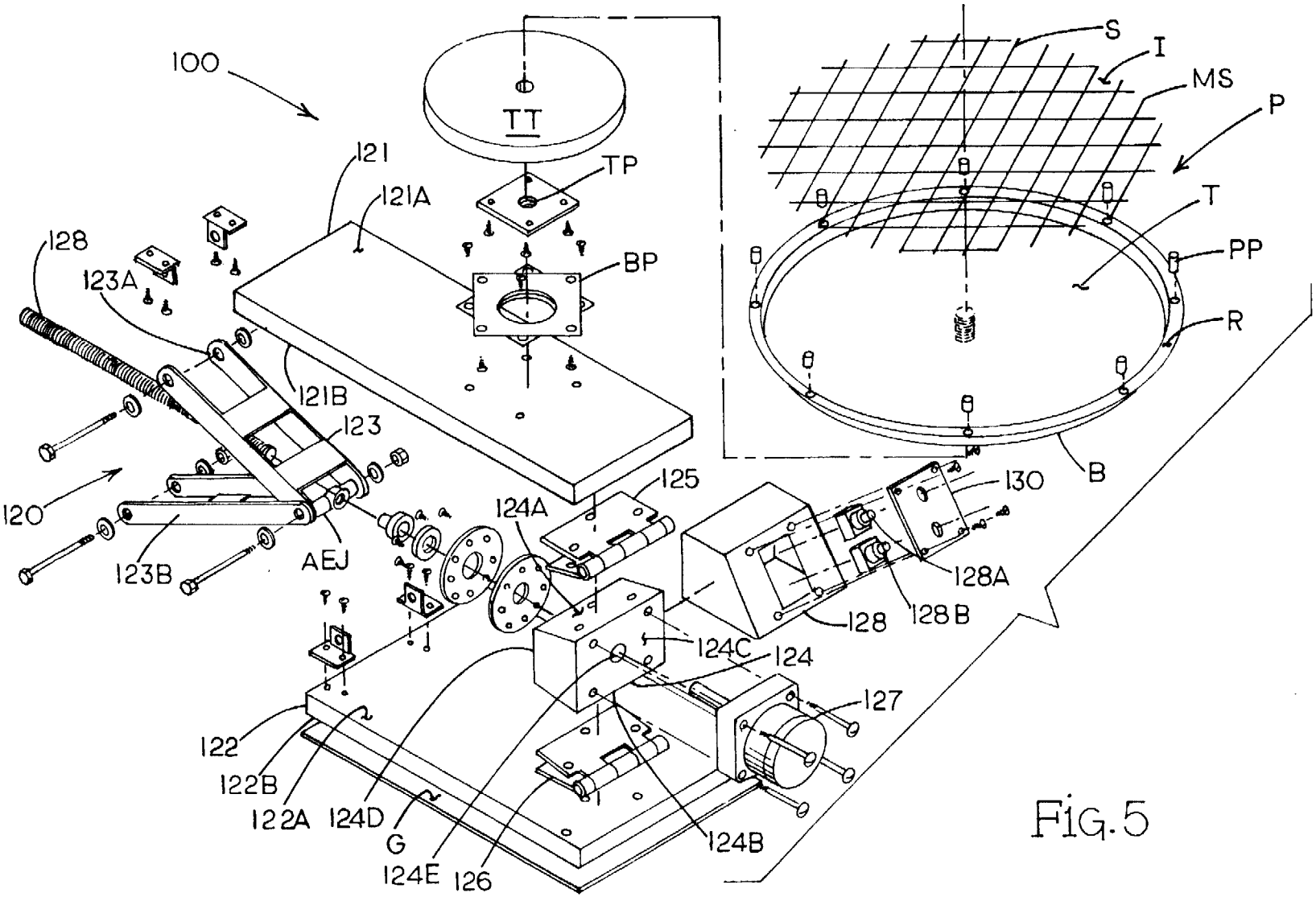
FIG. 5 is an exploded assembly drawing of the inventive banding wheel and plate shown in FIG. 1, but without the coating layer on the mesh screen of the plate.

FIG. 5 is an exploded assembly of banding wheel 100 and plate P as shown in FIG. 1, but without coating C on mesh screen MS and plate P. How tilting mechanism 120 works can be better understood with reference to FIG. 5.

More particularly, tilting mechanism 120 operates similarly to a scissors jack that is used for lifting an automobile in order to change a flat tire. Tilting mechanism 120 includes upper base block 121 having top 121A and bottom 121B and lower base block 122 having top 122A and bottom 122B.

Top 121A of upper base block 121 is shown with turntable TT disposed on it. More specifically, turntable TT includes threaded plate TP and bearing plate BP (available from Faultless as Part No. 27661 under the brand name LAZY SUSANS) by which turntable TT can be connected to top 121A of upper base block 121 of tilting mechanism 120. Typically, a diameter of about 12 inches (about 30.5 cm) is suitable for turntable TT.

Also, tilting mechanism 120 includes an articulating arm 123 having top portion 123A, bottom portion 123B, and articulating elbow joint AEJ. Arm top portion 123A is attached to bottom 121B of upper base block 121 and arm bottom portion 123B is attached to top 122A of lower base block 122.

Furthermore, tilting mechanism 120 includes connector block 124 having top 124A, bottom 124B, front 124C, back 124D, and orifice or aperture 124E, and includes first hinge 125 and second hinge 126. First hinge 125 connects bottom 121B of upper base block 121 to top 124A of connector block 124 and second hinge 126 connects top 122A of lower base block 122 to bottom 124B of connector block 124.

Moreover, tilting mechanism 120 includes motor 127 mounted to the front of connector block 124. A suitable motor is a HURST brand motor, Model No. PA (which is reversible and impedance protected), Part No. 3202-017 and Stock No. 6A177. Motor 127 is coupled to articulating elbow joint AEJ of movable arm 123 via threaded rod 128 passing through aperture or orifice 124E from front 124C to back 124D of connector block 124. Also, motor 127 is electrically connected in a conventional manner (not shown) to push button switch 128, having first button 128A (up) and second button 128B (down), mounted in switch cover plate 130. Rubber gasket G is affixed to the bottom surface 122B of lower base 122 to help prevent banding wheel 100 from slipping on a support surface.

In the inventive method, banding wheel 100 having tilting mechanism 120 and turntable TT, as described above, may be employed as follows. It is noted that the particular pottery article PA employed in the method was a dried pot that had been fired, but not glazed, and thus the pot was bisque.

Plate P includes mesh screen MS and coating C, which suitably is a mixture of beeswax and paraffin, affixed to the top surface T of plate P, and plate P is attached to turntable TT. In the alternative, plate P could be first attached to turntable TT, and then mesh screen MS and coating layer C would be placed on top surface T of plate P.

Coating C can be melted sufficiently to soften it by suitable means, and pottery article PA placed with its bottom on coating C and in the center of plate P. Pottery article PA is secured to banding wheel 100 by allowing coating C to cool, thereby hardening coating C and securing pottery article PA thereto.

Also, it is contemplated that pottery article PA may be secured to banding wheel 100 by placing a heated pottery article PA with its bottom to coating C so as to melt coating C beneath the pottery article. Coating C is then allowed to cool and thereby harden, which causes pottery article PA to stick to coating C.

More specifically with respect to the second technique, securing fired pottery article PA to banding wheel 100 is best achieved by placing pottery article PA, while it is still hot from being fired, on coating C so that the heat from pottery article PA melts coating C. Then, both pottery article PA and coating C are allowed to cool, and as coating C hardens, it causes pottery article PA to stick to coating C.

Then, a quadriplegic user may use his mouth to grasp a stick or the like (not shown) and use the end of the stick for engaging one of buttons 128A (to raise and tilt pottery article PA toward him), 128B (to lower pottery article PA away from him). Alternatively, a non-paralyzed person may use a finger to press one of buttons 128A,128B.

More particularly, pressing on button 128A runs motor 127 forward and allows for moving movable arm 123 upward, which in turn tilts upper base block 121 upward and thereby tilts turntable TT toward the open position of tilting mechanism 120. Movement ceases when button 128A is released. Likewise, pressing on button 128B runs motor 127 in reverse and allows for moving movable arm 123 downward, which in turn tilts upper base block 121 back down and thereby moves turntable TT back towards its initial horizontal position toward the closed position of tilting mechanism 120. Movement ceases when button 128B is released.

Since motor 127 is coupled to an articulating elbow joint BEJ via threaded rod 128 passing through aperture or orifice 124E from front 124C to back 124D of connector block 124, running of motor 127 forward causes upward movement of top portion 123A of movable arm 123 which in turn tilts upper base block 121 and thereby tilts turntable TT. As a result, turntable TT with pottery article PA secured thereto can be selectively tilted via tilting mechanism 120 so that the vertical rotational axis VA of pottery article PA is offset up to about 10° from vertical without pottery article PA releasing from coating C on mesh screen MS. Although applicants' turntable TT of banding wheel 100 can be tilted up to said 10° by a quadriplegic user to facilitate use, applicants do not intend to limit their invention to this specific maximum angle and believe that many other angles could be established for banding wheel 100 that would still be within the scope of the invention.

It is noted that plate P is illustrated in its preferred embodiment having push projections PP for rotating plate P, and thereby rotating turntable TT when plate P is attached to turntable TT. Therefore, a quadriplegic may use the mouth to grasp a stick (not shown) and then use the end of the stick for engaging one of projections PP, thus pushing plate P in order to rotate it and thereby rotate pottery article PA secured to banding wheel 100 so that the quadriplegic may perform work on all sides of pottery article PA. For instance, the quadriplegic may glaze pottery article PA using a brush (not shown) grasped with the mouth. Also, if pottery article PA has been already glazed and fired, the paraplegic may paint designs on glazed and fired pottery article PA using a brush (not shown) grasped with the mouth. When the quadriplegic is finished working on pottery article PA, the non-paralyzed person may then remove plate P with pottery article PA intact, heat coating C sufficiently to cause it to melt and lift pottery article PA off of coating mixture C.

It is contemplated that banding wheel 100 may be a separate apparatus, distinct from a conventional banding wheel (which cannot be used by a quadriplegic to glaze, etc. a pottery article as can the instant invention). Also, turntable TT of banding wheel 100 may be connected to a conventional motor (not shown) or foot pedal (not shown). Then, the motor or foot pedal is used for rotating turntable TT and thereby rotating plate P when plate P is attached to turntable TT.

It will be understood that various details of the invention may be changed without departing from the scope of the invention. Furthermore, the above description is for the purpose of illustration only, and not for the purpose of limitation—the invention being defined by the claims.

What is claimed is:

1. In combination, a banding wheel and a plate, (a) the banding wheel comprising:

(i) a turntable being rotatable, and adapted for releasable attachment to a support plate, wherein the plate is adapted for releasably securing a pottery article to the banding wheel;

(ii) a mechanism connected to the turntable and adapted for tilting the turntable, and when the tilting mechanism is in its closed position, the turntable is horizontally disposed, and when the mechanism is in its open position, the turntable is angularly disposed; and (b) the support plate comprising:

(i) a top surface;

(ii) a bottom surface; and (iii) a mesh screen affixed to the top surface and having a paraffinic coating layer thereover.

2. The combination of claim 1, wherein the tilting mechanism includes:

(a) an upper base block having a top and a bottom, with the top having the turntable disposed thereon;

(b) a lower base block having a top and a bottom;

(c) a movable arm, having a top portion, a bottom portion, and a articulating elbow joint, with the arm top portion attached to the upper base block and the arm bottom portion attached to the lower base block;

(d) a connector block having a top, a bottom, a front, and a back;

(e) a first hinge and a second hinge, with the first hinge connecting the upper base block to the top of the connector block and the second hinge connecting the lower base block to the bottom of the connector block; and (f) a motor operatively coupled to the elbow joint, such that the motor allows for moving the movable arm which in turn tilts the upper base block and thereby tilts the turntable.

3. The combination of claim 1, wherein the support plate includes projections for rotating the plate, and thereby rotating the turntable when the plate is attached to the turntable.

4. The combination of claim 1, wherein the support plate has a circumferential rim and the mesh screen is affixed inside the plate circumferential rim and on the plate top surface.

5. A process for releasably securing a pottery article to a banding wheel, the process comprising the steps of:

(a) providing a banding wheel having (i) a turntable, with the turntable being rotatable and being adapted for releasable attachment to a support plate; (ii) a mechanism connected to the turntable and adapted for tilting the turntable, wherein when the tilting mechanism is in its closed position, the turntable is horizontally disposed and when the mechanism is in its open position, the turntable is angularly disposed;

(b) providing a plate comprising (i) a top surface, (ii) a bottom surface, and (iii) a mesh screen affixed to the top surface of the plate and having a wax coating layer thereon;

(c) attaching the plate to the turntable;

(d) placing a heated pottery article on the wax coating layer of the plate; and (e) securing the pottery article to the banding wheel by allowing the wax coating layer to cool, thereby hardening the coating, whereby the turntable with the pottery article secured thereto may be selectively tilted by the tilting mechanism without the pottery article falling from the support plate.

6. The process of claim 5, wherein step (a) includes providing a banding wheel wherein the tilting mechanism includes:

(a) an upper base block having a top and a bottom, with the top having the turntable rotatably disposed thereon;

(b) a lower base block having a top and a bottom;

(c) a movable arm, having a top portion, a bottom portion, and an articulating elbow joint, with the arm top portion attached to the upper base block and the arm bottom portion attached to the lower base block;

(d) a connector block having a top, a bottom, a front, and a back;

(e) a first hinge and a second hinge, with the first hinge connecting the upper base block to the top of the connector block and the second hinge connecting the top of the lower base block to the connector block; and (f) a motor coupled to the movable arm elbow joint such that the motor allows for moving the movable arm which in turn tilts the upper base block and thereby tilts the turntable.

7. A process for releasably securing a pottery article to a banding wheel, the process comprising the steps of:

(a) providing a banding wheel having (i) a turntable, with the turntable being rotatable and being adapted for releasable attachment to a support plate; (ii) a mechanism connected to the turntable and adapted for tilting the turntable, wherein when the tilting mechanism is in its closed position, the turntable is horizontally disposed and when the mechanism is in its open position, the turntable is angularly disposed;

(b) providing a plate comprising (i) a top surface, (ii) a bottom surface, and (iii) a mesh screen affixed to the top surface of the plate and having a wax coating layer thereon;

(c) heating the plate so as to melt the wax coating layer;

(d) attaching the plate to the turntable;

(e) placing a pottery article on the wax coating layer of the plate; and (f) securing the pottery article to the banding wheel by allowing the wax coating layer to cool, thereby hardening the coating, whereby the turntable with the pottery article secured thereto may be selectively tilted by the tilting mechanism without the pottery article falling from the support plate.

8. The process of claim 7, wherein step (a) includes providing a banding wheel wherein the tilting mechanism includes:

(a) an upper base block having a top and a bottom, with the top having the turntable rotatably disposed thereon;

(b) a lower base block having a top and a bottom;

(c) a movable arm, having a top portion, a bottom portion, and a articulating elbow joint, with the arm top portion attached to the upper base block and the arm bottom portion attached to the lower base block;

(d) a connector block having a top, a bottom, a front, and a back;

(e) a first hinge and a second hinge, with the first hinge connecting the upper base block to the top of the connector block and the second hinge connecting the top of the lower base block to the connector block; and (f) a motor coupled to the movable arm elbow joint such that the motor allows for moving the movable arm which in turn tilts the upper base block and thereby tilts the turntable.

9. A banding wheel comprising:

(a) a turntable that is (i) rotatable, and (ii) adapted for releasable attachment to a support plate, wherein the plate includes means for releasably securing a pottery article to the banding wheel; and (b) a mechanism operatively connected to the turntable and adapted for tilting the turntable from a substantially horizontal position when the mechanism is in its closed position, to a tilted position when the mechanism is in its open position, wherein the tilting mechanism includes:

(i) an upper base block having a top and a bottom, with the top having the turntable disposed thereon;

(ii) a lower base block having a top and a bottom;

(iii) a movable arm, having a top portion, a bottom portion, and an articulating elbow joint, with the arm top portion attached to the upper base block and the arm bottom portion attached to the lower base block;

(iv) a connector block having a top, a bottom, a front, and a back;

(v) a first hinge and a second hinge, with the first hinge connecting the upper base block to the top of the connector block and the second hinge connecting the lower base block to the bottom of the connector block; and (vi) a motor operatively coupled to the elbow joint of the movable arm such that the motor allows for moving the movable arm which in turn tilts the upper base block and thereby tilts the turntable.

10. A banding wheel comprising:

(a) a turntable that is (i) rotatable, and (ii) adapted for releasable attachment to a support plate, wherein the plate includes means for releasably securing a pottery article to the banding wheel, the plate has projections for rotating the plate and thereby rotating the turntable when the plate is attached to the turntable, and the plate includes a mesh screen having a paraffinic coating layer thereon for releasably securing a pottery article; and (b) a mechanism operatively connected to the turntable and adapted for tilting the turntable from a substantially horizontal position when the mechanism is in its closed position, to a tilted position when the mechanism is in its open position.

* * * * *